US011820129B2

(12) United States Patent
Haigis et al.

(10) Patent No.: US 11,820,129 B2
(45) Date of Patent: Nov. 21, 2023

(54) LABEL PRINTER

(71) Applicant: Bizerba SE & Co. KG, Balingen (DE)

(72) Inventors: Joerg Haigis, Balingen (DE); Steffen Link, Albstadt (DE)

(73) Assignee: Bizerba SE & Co. KG, Balingen (DE)

( * ) Notice: Subject to any disclaimer, the term of this patent is extended or adjusted under 35 U.S.C. 154(b) by 191 days.

(21) Appl. No.: 17/371,258

(22) Filed: Jul. 9, 2021

(65) Prior Publication Data

US 2022/0016914 A1 Jan. 20, 2022

(30) Foreign Application Priority Data

Jul. 14, 2020 (EP) ..... 20185815

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 3/4075; B41J 15/044; B41J 29/02; B41J 29/00; B41J 29/023; B41J 29/026
See application file for complete search history.

(56) References Cited

U.S. PATENT DOCUMENTS 6,406,202 B1 6/2002 Unno et al.
2006/0198680 A1* 9/2006 Yamamoto ..... B41J 2/325 400/120.16

FOREIGN PATENT DOCUMENTS

EP 2 275 270 B1 2/2012
JP H10-76712 A 3/1998

OTHER PUBLICATIONS

European Search Report dated Nov. 24, 2020 of corresponding European Patent Application No. 20185815.6 (three pages).

* cited by examiner

*Primary Examiner* — Kristal Feggins
(74) *Attorney, Agent, or Firm* — Kilpatrick Townsend & Stockton LLP

(57) ABSTRACT

Disclosed is a label printer for printing labels wound onto a roll that are applied to a carrier tape or that are linerless endless tape labels, having a housing in which a cartridge compartment is formed; a tape cartridge which at least comprises an unwinding mandrel, in which a label roll can be received, and which can be manually inserted into and removed from the cartridge compartment; and a printhead and a driven print roller, wherein the label tape of the label roll can be led between the printhead and the print roller. A spring device and a movable latching holder, which is preloaded into a latching position by a spring force of the spring device, allows the tape cartridge to be latched into the latching holder against the spring force on the insertion and to be unlatched from the latching holder against the spring force on the removal.

22 Claims, 6 Drawing Sheets

LABEL PRINTER

Figure 1:
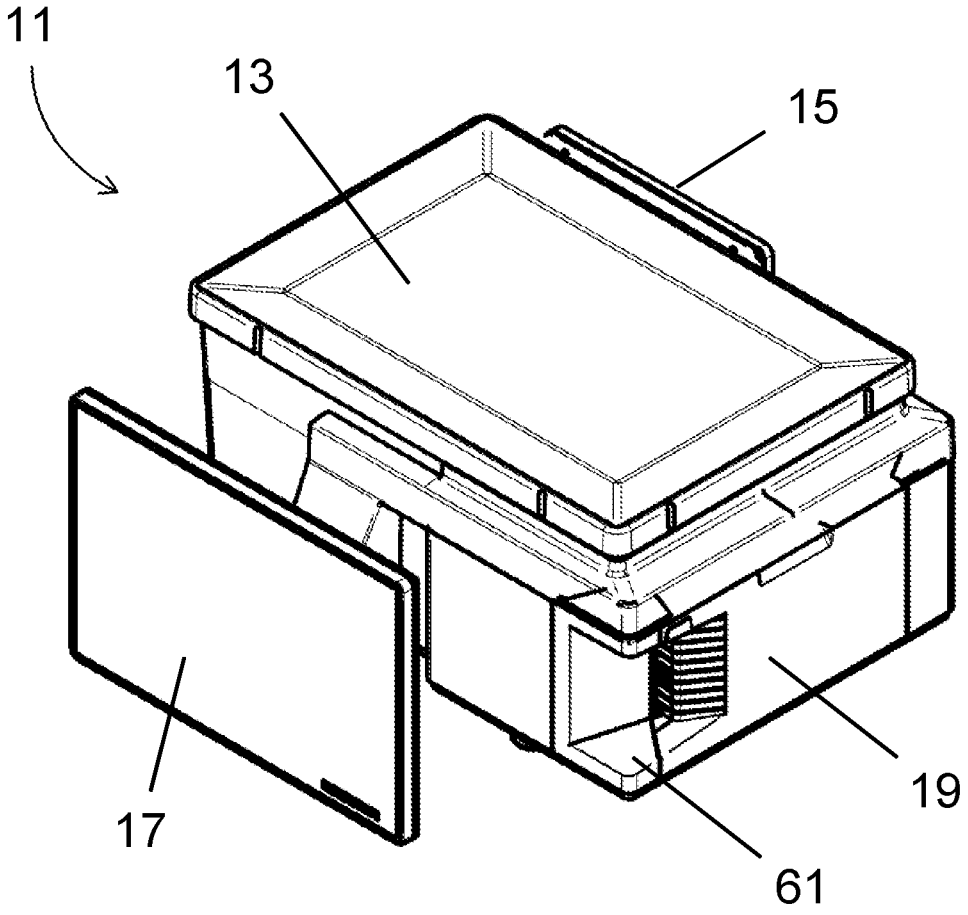

This application claims priority to European Patent Application 20185815.6, filed on Jul. 14, 2020, the disclosure of which is incorporated by reference herein.

The invention relates to a label printer for printing labels wound onto a roll that are applied to a carrier tape or that are linerless endless tape labels, said label printer comprising a housing in which a cartridge compartment is formed; a tape cartridge which at least comprises an unwinding mandrel, in which a label roll can be received, and which can be manually inserted into the cartridge compartment and removed from the cartridge compartment; and a printhead and a driven print roller, wherein the label tape, i.e. the carrier tape or the endless tape, of the label roll can be led between the printhead and the print roller.

Without a tape cartridge, the label roll itself has to be handled and placed onto an unwinding mandrel in the housing and the label tape start has to be correctly inserted into the label printer. With a carrier tape, the label tape start has to be threaded into a winding mandrel. This is not necessary when using easier-to-handle tape cartridges such that label rolls can be changed in a simpler and faster manner and without problem. However, it is necessary for the tape cartridge to be securely held in the inserted position in order to avoid a malfunction of the label printer.

It is the underlying object of the invention to provide a label printer of the initially mentioned type in which the tape cartridge can be securely held in the inserted position and can simultaneously be changed in a user-friendly manner.

This object is satisfied by a label printer having the features of claim 1, and in particular in that a spring device and a movable latching holder, which is preloaded into a latching position by a spring force of the spring device, for the tape cartridge are associated with the cartridge compartment, with the tape cartridge being able to be latched into the latching holder against the spring force on the insertion and being able to be unlatched from the latching holder against the spring force on the removal.

The spring force of the spring device therefore has to be overcome both on the insertion and on the removal of the tape cartridge. Due to the latching mechanism in accordance with the invention, the tape cartridge can, on the one hand, be securely held in the inserted position and can, on the other hand, nevertheless be inserted into the cartridge compartment and removed from the cartridge compartment without any particular effort, merely with one hand movement in each case and thus in a user-friendly manner. No locking is required to hold the tape cartridge in the inserted position and which tape cartridge would have to be previously released before the tape cartridge can be removed from the inserted position again. The operator therefore does not have to actuate a button, a handle or the like to be able to remove the tape cartridge. The force which the operator has to apply to latch and unlatch the tape cartridge can be predefined via the selected spring hardness of the spring device.

Provision is in particular made that, on the insertion and on the removal, the tape cartridge in each case presses against the latching holder such that the latching holder is temporarily urged out of the latching position against the spring force in order to allow a latching in and an unlatching. On the insertion and on the removal of the tape cartridge, the latching holder initially in each case deflects against the spring force of the spring device and is subsequently urged back into the latching position as soon as the tape cartridge has reached the inserted position or has been removed sufficiently far.

For this purpose, the latching holder can have a contact section having two run-on slopes, with the tape cartridge pressing against the one run-on slope on the insertion and pressing against the other run-on slope on the removal. The latching mechanism can hereby be realized in a simple manner. The two run-on slopes in particular each extend obliquely to the direction of a movement of the latching holder out of the latching position. The two run-on slopes in this respect do not have to extend in a strictly linear manner, i.e. it is not necessary for the respective run-on slope to have a constant positive or negative gradient.

The two run-on slopes can together form a V shape in a plane that is defined by the direction of a movement of the latching holder out of the latching position and the direction of movement of the tape cartridge on the insertion and removal. The two run-on slopes run toward one another and together form a tip of the contact section. A fast and defined switching between the latched-in position and the unlatched position of the tape cartridge is thus possible.

The movable latching holder is preferably configured as a latching holder pivotable about a pivot axis, in particular as a pivotable latching arm. However, it is generally also possible for the latching holder to be linearly movable out of the latching position. A pivot support can be realized in a comparatively simple manner with respect to a linear guide. In this respect, the spring device can be a torsion spring that preloads the pivotable latching holder into the latching position. A torsion spring is particularly well suitable for the realization of a preload in a pivot support.

For reasons of symmetry, in order to counteract a tilting of the tape cartridge and/or in order to achieve a double securing of the tape cartridge in the inserted position, it is preferred if, in the inserted position of the tape cartridge, such a spring device and such a latching holder are in each case provided at two mutually oppositely disposed sides of the tape cartridge. The two latching holders can be rigidly coupled to one another or can be moved independently of one another.

The print roller can in particular be part of the tape cartridge. The print roller is thus removed from the housing with the tape cartridge on each label roll change. If necessary, the print roller can be replaced more easily from the removed tape cartridge than from the housing of the label printer. This is in particular advantageous on a change from labels applied to a carrier tape to linerless endless tape labels, or vice versa, as the print roller is then usually also changed since a print roller for linerless endless tape labels is typically composed of a different material than a print roller for labels applied to a carrier tape. In this respect, it is preferred if the print roller can be replaced without tools. This can in particular be achieved in that rotary bearings of the print roller are received in corresponding recesses of the tape cartridge while forming a press fit that can be released by hand.

In accordance with a preferred embodiment of the invention, provision is made that the tape cartridge, with a respective axial end of an axle of the print roller, latches into the respective latching holder and unlatches from the respective latching holder. The print roller is hereby directly fixed and can be held in a precisely defined position relative to the printhead of the label printer. However, it is generally also conceivable that the respective latching holder engages at another point than at the respective axial end of the print roller. One or two latching holders can be provided.

A housing element foldable about an axis of rotation between a closed position and an open position, in particular a door, is preferably attached to the housing and releases access to the cartridge compartment for inserting and removing the tape cartridge in the open position and prevents said access in the closed position. The tape cartridge can therefore only be inserted or removed when the housing element is open. The printhead and the print roller are located protected from dust in the interior of the housing.

A holding device is preferably provided to hold the housing element at the housing in the closed position. The holding device can, for example, have a locking that has to be released before the housing element can be folded into the open position again. However, only a magnetic holder is preferably provided to hold the housing element at the housing in the closed position. The housing element can thus be folded into the open position in a direct manner, merely by overcoming the magnetic force of the magnetic holder, without a locking having to be previously released for this purpose. Such an opening is very comfortable for an operator.

In accordance with a further preferred embodiment of the invention, the housing element is provided with a securing means that blocks a movement of the latching holder out of the latching position in the closed position of the housing element. In the operation of the label printer, forces can arise due to rotating components, said forces acting with at least one component in the direction of a movement of the tape cartridge out of the latched-in position. This can in particular be the case if the label printer is operated with linerless endless tape labels and the print roller is part of the tape cartridge. In the case of linerless endless tape labels, which are also called linerless labels, a cutter is required which is connected downstream of the printhead and of the print roller and by which the respective printed label is cut off from the endless tape. Since the next label has in this respect already partly passed through the printing region between the printhead and the print roller, and provided that the label is also to be printed in the part region that has already been passed through, the endless tape is pulled back up to the label start of the next label at which the previous label was cut off (reversing). For this purpose, the print roller is operated in the reverse direction of rotation, whereby the aforementioned forces can arise. These forces can generally be counteracted by a spring device having a high spring stiffness. However, the insertion and the removal of the tape cartridge then become more difficult and thus uncomfortable for the operator. These forces can likewise be counteracted by the securing means without a particularly high spring stiffness of the spring device being required in this respect. In this respect, it is preferred if the securing means automatically becomes active due to the mere closing of the housing element, i.e. the securing means does not have to be actuated separately for this purpose.

The securing means can have a blocking element that is provided at an inner side of the housing element, that projects with a free end in the direction of the latching holder in the closed position of the housing element, and that acts in a blocking manner on the latching holder in the closed position of the housing element. The securing means can hereby be realized in a simple manner.

The blocking element preferably directly contacts the latching holder in the closed position of the housing element, i.e. not indirectly via one or more other force-transmitting components. The design can thereby be kept particularly simple and consequently little susceptible to faults.

It is preferred if, in the closed position of the housing element, a force, in particular as it has been described above, acting on the latching holder in the direction of a movement out of the latching position acts on the blocking element such that no torque is exerted onto the foldable housing element. It can thus be ensured that a force acting on the latching holder in the direction of a movement out of the latching position is completely led off into the rotary bearing of the housing element and thus cannot in any way lead to an opening movement of the housing element, even in the case of high forces that could, for example, occur in the event of a significant malfunction. It is thus in particular sufficient if a magnetic holder is used as the holding device to hold the housing element at the housing in the closed position, wherein the magnetic holder in this respect only has to have a small magnetic force such that the housing element can be operated particularly comfortably.

That no torque is exerted onto the foldable housing element, can in particular be achieved by the direction of the movement of the latching holder out of the latching position being oriented in parallel with a radial extent of the foldable housing element in the closed position of the housing element and/or being oriented perpendicular to the free end of the blocking element in the closed position of the housing element.

The blocking element is preferably manufactured as a stamped bent part composed of sheet metal. A stamped bent part can be inexpensively manufactured and can be easily screwed to the inner side of the housing element. Thus, the securing can be realized by simple means and without high costs.

Provision is in particular made that the axis of the unwinding mandrel runs in the vertical in the operating position of the label printer. A flat label printer of a low overall height can hereby be realized.

The present invention furthermore relates to a scale, in particular to a store scale, comprising a label printer as it has been explained above.

Further advantageous embodiments of the invention are described in the dependent claims, in the description of the Figures, and in the drawing.

Figure 2:
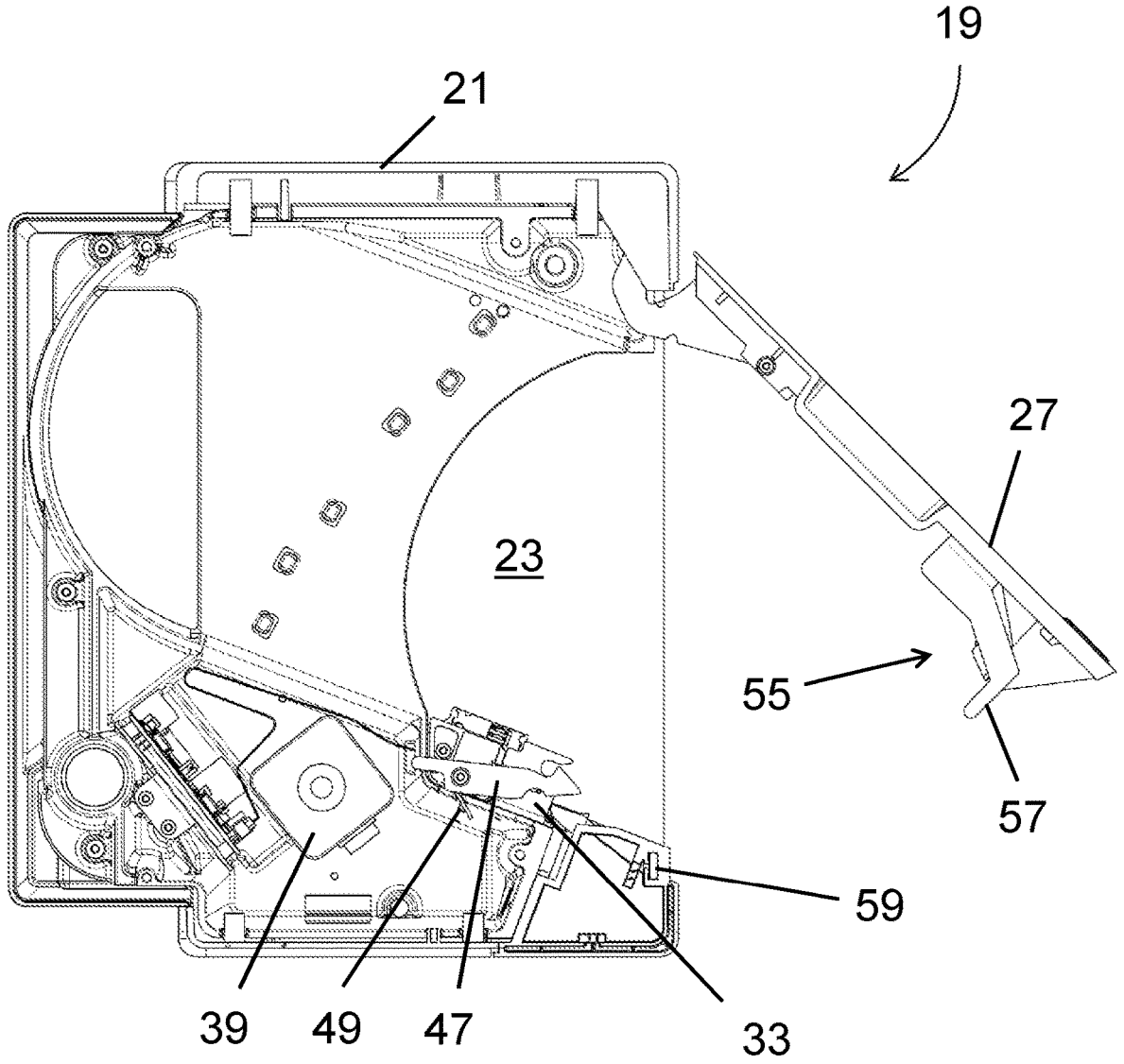
Figure 3:
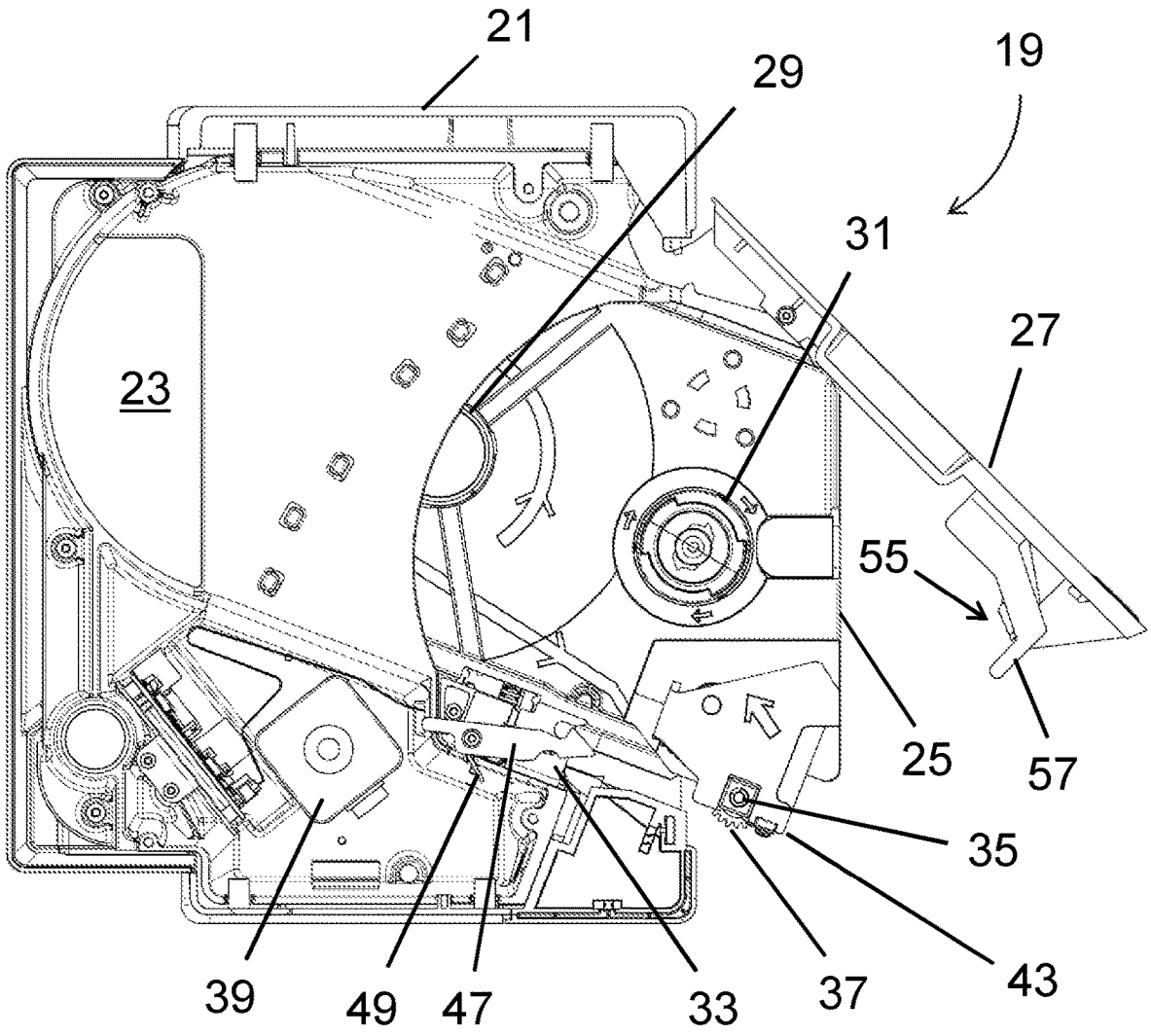
Figure 4:
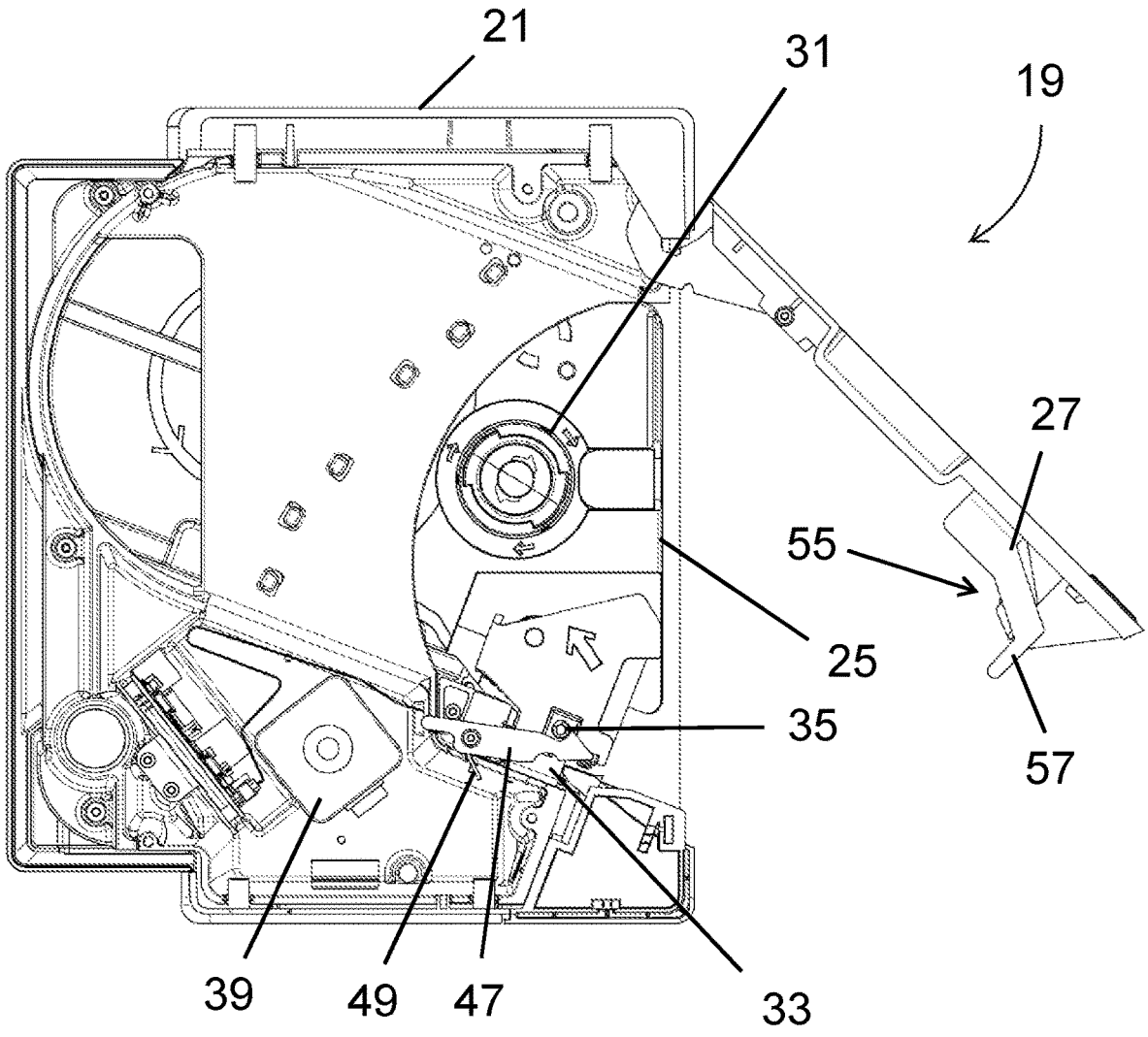
Figure 5:
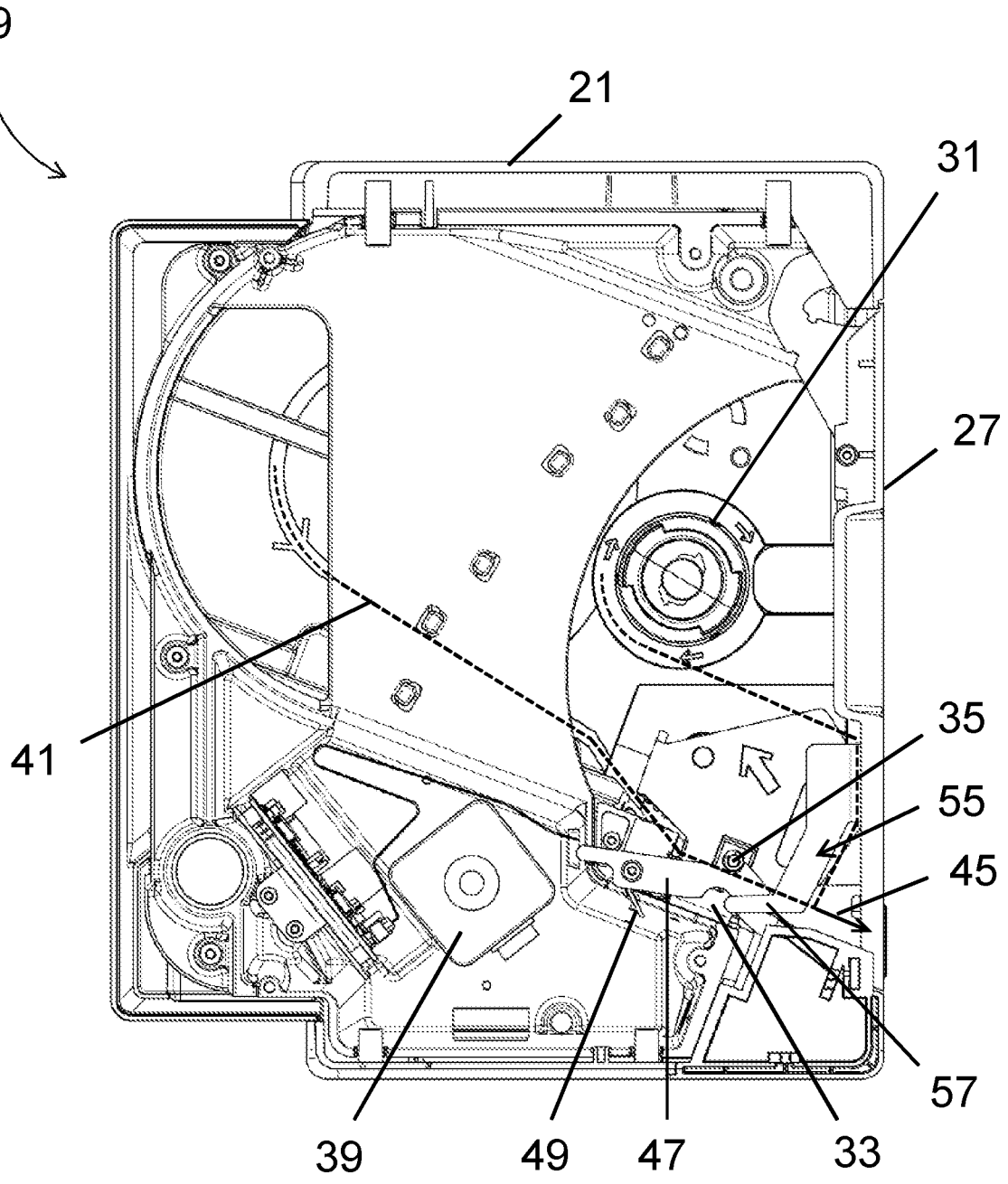
Figure 6:
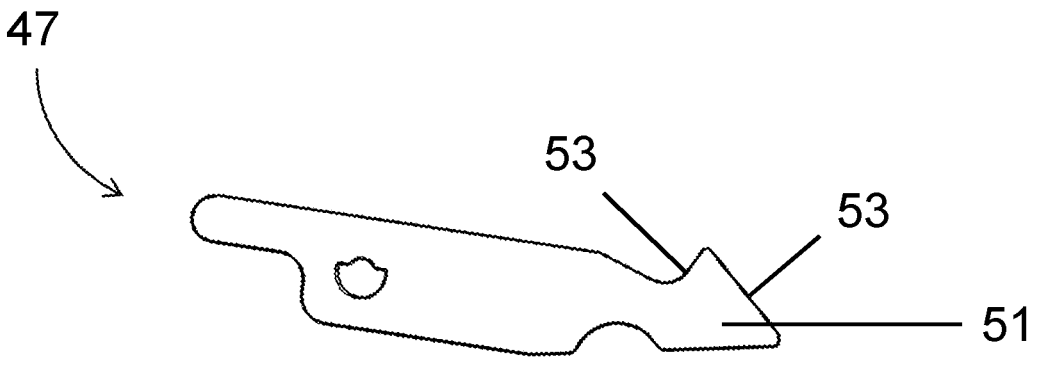
Figure 7:
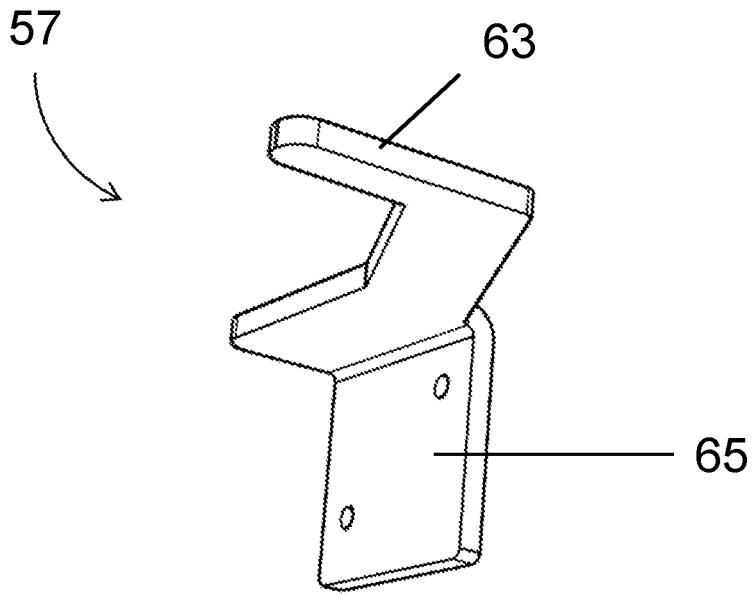

The invention will be described in the following by way of example with reference to the drawing. There are shown FIG. 1 a scale with a label printer in accordance with the invention in a perspective view;

FIG. 2 the label printer of FIG. 1 with a cartridge compartment, without a tape cartridge, and with an open door in a plan view;

FIG. 3 the label printer in accordance with FIG. 2, wherein a tape cartridge is partly inserted into the cartridge compartment;

FIG. 4 the label printer in accordance with FIG. 3, with the tape cartridge being completely inserted into the cartridge compartment;

FIG. 5 the label printer in accordance with FIG. 4, with the door being closed;

FIG. 6 a latching holder of the label printer in accordance with FIGS. 2 to 5 in an enlarged individual representation; and FIG. 7 a securing means of the label printer in accordance with FIGS. 2 to 5 in an enlarged individual representation.

The exemplary scale, in particular a store scale, shown in FIG. 1 comprises a load plate 13 that determines the weight of an article disposed on it, with the weight being displayed both on a display 15 for the customer and on a display 17 for the salesperson. The display 17 is configured as a touch screen such that the scale 11 can also be operated via it. An identification number (PLU) associated with the respective article can be input via the touch screen 17 such that a price for the article can be calculated while adding the weight, said price then likewise being displayed on the two displays 15, 17. Furthermore, the store scale comprises a label printer 19 to print the weight, the name of the article, and the calculated price on the label.

The label printer 19 is shown in FIGS. 2 to 5 in an individual representation and in a plan view respectively. The label printer 19 comprises a housing 21 in which a cartridge compartment 23 is formed into which a tape cartridge 25 (cf. FIGS. 3 to 5) is insertable. Furthermore, a housing element 27 attached to the housing 21 in a manner foldable about an axis of rotation is provided in the form of a door and is adjustable between an open position shown in FIGS. 2 to 4 and a closed position shown in FIG. 5. In the open position of the housing element 27, access to the cartridge compartment 23 is unobstructed, i.e. the tape cartridge 25 can be manually inserted into the cartridge compartment 23 or manually removed from the cartridge compartment 23. In the closed position of the housing element 27, in contrast, this is not the case since the access is then closed.

The label printer 19 can be operated with labels that are applied to a carrier tape, that are wound onto a roll, and that are thus received as a label roll in the tape cartridge 25. In this respect, the label roll is placed onto an unwinding mandrel 29 of the tape cartridge 25 which is oriented vertically in the operating position of the label printer 19 and from which the label tape is unwound in the operation of the label printer 19. In addition, the tape cartridge 25 has a driven winding mandrel 31 for the unwound carrier tape.

Furthermore, a printhead 33 and a driven print roller 35 cooperating with the printhead 33 are provided. The printhead 33 is arranged in the housing 21. The print roller 35, in contrast, is part of the tape cartridge 25. At its two axial ends, the print roller 35 is in each case supported in a separate rotary bearing, said rotary bearings being pressed in a form-fitted and force-fitted, yet releasable manner into corresponding recesses of the tape cartridge 25 such that the print roller 35 can be replaced without tools.

The print roller 35 and the winding mandrel 31 are driven by an electric motor 39 of the label printer 19 via a gear transmission of which a toothed wheel 37 can be recognized in FIG. 3. The tape cartridge 25 thus does not have its own electric motor. The carrier tape 41 with the labels is in this respect led between the printhead 33 and the print roller 35 in order to print the labels, as is schematically indicated in FIG. 5. After the printing region, the carrier tape 41 is sharply deflected around a dispensing edge 43 (cf. FIG. 3) such that the labels can peel off and can be output from the label printer 19, as is illustrated by an arrow 45 in FIG. 5.

Alternatively to an operation with a carrier tape 41, the label printer 19 may also be operated with linerless endless tape labels that are also called linerless labels. A winding mandrel is not necessary for linerless endless tape labels. However, a cutter which is arranged behind the printhead 33 and the print roller 35 and by which the labels are cut off from the endless tape is required for this purpose. Such a cutter is then located in the region of the bottom right corner of the housing 21 of the label printer 19 in FIGS. 2 to 5, wherein the housing corner section 61 shown in FIG. 1 is then replaced with a corresponding housing corner section having the cutter.

To securely hold the tape cartridge 25 in the cartridge compartment 23, a latching mechanism is provided in which the tape cartridge 25 can be latched into the inserted position against a spring force on the insertion and can be unlatched from the inserted position against the spring force on the removal. For this purpose, the cartridge compartment 23 has associated with it at least one latching holder 47 in the form of a latching arm which is pivotable about a pivot axis and which is preloaded by an associated spring device 49 in the form of a torsion spring into a latching position, counter-clockwise in FIGS. 2 to 5. In this respect, the latching holder 47 cooperates with one of the two axial ends of the print roller 35 or of the axle of the print roller 35 via a contact section 51 (cf. in particular FIG. 6) provided at the free end of the latching holder 47.

The contact section 51, which is preloaded by means of the spring device 49 in the direction of the path along which the tape cartridge 25 is inserted into the cartridge compartment 23 or removed from the cartridge compartment 23, has two run-on slopes 53 that converge in a V shape in the pivot plane of the latching holder 47. In FIGS. 2 and 3, i.e. when the tape cartridge 25 is not yet or only partly inserted into the cartridge compartment 23, the contact section 51 projects with the tip formed by the two run-on slopes 53 into the aforementioned path.

On the further insertion, the axial end of the axle of the print roller 35 presses against the run-on slope 53 of the contact section 51 at the right in FIGS. 2 to 5 such that the latching holder 47 is temporarily urged out of the latching position against the spring force of the spring device 49, clockwise in FIGS. 2 to 5. As soon as the axial end of the axle of the print roller 35 has passed the tip of the contact section 51, the latching holder 47 and thus the contact section 51 are urged back into the latching position again and the axial end of the axle of the print roller 35 latches in behind the contact section 51 (cf. FIGS. 4 and 5). The removal of the tape cartridge 25 takes place analogously in the reverse direction, wherein the axial end of the axle of the print roller 35 then presses against the run-on slope 53 of the contact section 51 that is at the left in FIGS. 2 to 5.

An arrangement as described above preferably engages with the latching holder 47 and the spring device 49 not only at the axial end of the axle of the print roller 35 visible in FIGS. 2 to 5, but at both axial ends, i.e. a total of two such latching holders 47 and two such spring devices 49 are provided. The two latching holders 47 can be rigidly coupled to one another or can be independently movable of one another.

A securing means 55 is further provided by which a pivot movement of the latching holder 47 out of the latching position can be blocked in the closed position of the housing element 27. The securing means 55 comprises a blocking element 57 which, in the closed position of the housing element 27, projects with a free end 63 (cf. in particular FIG. 7) in the direction of the latching holding 47 and in this respect directly contacts the latching holder 27 such that the latching holder 47 can no longer pivot out of the latching position. The blocking element 57 is formed as a stamped bent part that is screwed to the inner side of the housing element 27 via a fastening section 65. No securing means of this type is provided for the second latching holder.

The securing means 55 is therefore advantageous since, in the case of linerless labels, when a label is cut off, the next label has already partly run through between the printhead 33 and the print roller 35 and the endless tape therefore has to be retracted up to the label start of the next label. On this so-called reversing, during which the print roller 35 briefly does not rotate in the forward direction, but rather in the reverse direction, forces can arise that act on the inserted tape cartridge 25 in the direction of a movement into the unlatched position. In the case of small spring stiffnesses of the spring devices 49, as is preferred for a particularly comfortable insertion and removal of the tape cartridge 25, there is then the risk that the inserted tape cartridge 25 unlatches in an unwanted and automatic manner. Such an unlatching can be prevented by the securing means 55. Since the securing means 55 is provided at the inner side of the housing element 27, the securing means 55 automatically becomes active due to the mere closing of the housing element 27.

An arrangement that is particularly secure with respect to the prevention of an unwanted unlatching is achieved in that no torque is exerted onto the foldable housing element 27 by a force that attempts to urge the latching holder 47 out of the latching position when the tape cartridge 25 is inserted and in the closed position of the housing element 27. It is thereby ensured that, in the closed position of the housing element 27, the radial extent of the housing element 27 is aligned in parallel with and the free end 63 of the blocking element 57 is oriented perpendicular to the direction of the movement of the latching holder 47 out of the latching position.

Finally, a holding device 59 for the housing element 27 is also provided in the housing 21 in the form of a magnetic holder having a magnet that attracts the free end of the at least partly metallic housing element 27 and that thus holds the housing element 27 in the closed position. In this respect, it is sufficient for the magnet to generate only a weak magnetic field in order to enable an opening of the housing element 27 for an operator that is as force free as possible and that is thus comfortable.

REFERENCE NUMERAL LIST

11 scale
13 load plate
15 customer display
17 operator touch screen
19 label printer
21 housing
23 cartridge compartment
25 tape cartridge
27 housing element
29 unwinding mandrel
31 winding mandrel
33 printhead
35' print roller
37 toothed wheel
39 electric motor
41 carrier tape
43 dispensing edge
45 arrow
47 latching holder
49 spring device
51 contact section
53 run-on slope
55 securing means
57 blocking element
59 holding device
61 housing corner section
63 free end
65 fastening section

The invention claimed is:

1. A label printer for printing labels wound onto a roll that are applied to a carrier tape or that are linerless endless tape labels, said label printer comprising:

a housing in which a cartridge compartment is formed;

a tape cartridge which at least comprises an unwinding mandrel, in which a label roll can be received, and which can be manually inserted into the cartridge compartment and removed from the cartridge compartment; and a printhead and a driven print roller, wherein a label tape of the label roll can be led between the printhead and the print roller, wherein a spring device and a movable latching holder, which is preloaded into a latching position by a spring force of the spring device, for the tape cartridge are associated with the cartridge compartment, with the tape cartridge being able to be latched into the latching holder against the spring force on the insertion and being able to be unlatched from the latching holder against the spring force on the removal, wherein the print roller is part of the tape cartridge, and wherein the tape cartridge, with a respective axial end of an axle of the print roller, latches into the respective latching holder and unlatches from the respective latching holder.

2. The label printer in accordance with claim 1, wherein, on the insertion and on the removal, the tape cartridge in each case presses against the latching holder such that the latching holder is temporarily urged out of the latching position against the spring force in order to allow a latching in and an unlatching.

3. The label printer in accordance with claim 2, wherein the latching holder has a contact section having two run-on slopes, with the tape cartridge pressing against one of the two run-on slopes on the insertion and pressing against the other run-on slope on the removal.

4. The label printer in accordance with claim 3, wherein the two run-on slopes together form a V shape in a plane that is defined by a direction of a movement of the latching holder out of the latching position and a direction of movement of the tape cartridge on the insertion and removal.

5. The label printer in accordance with claim 1, wherein the movable latching holder is configured as a latching holder pivotable about a pivot axis.

6. The label printer in accordance with claim 5, wherein the spring device is a torsion spring that preloads the pivotable latching holder into the latching position.

7. The label printer in accordance with claim 5, wherein the movable latching holder is a pivotable latching arm pivotable about the pivot axis.

8. The label printer in accordance with claim 1, wherein, in the inserted position of the tape cartridge, such a spring device and such a latching holder are in each case provided at two mutually oppositely disposed sides of the tape cartridge.

9. The label printer in accordance with claim 1, wherein the print roller is replaceable without tools.

10. The label printer in accordance with claim 1, wherein a housing element foldable about an axis of rotation between a closed position and an open position is attached to the housing and releases access to the cartridge compartment for inserting and removing the tape cartridge in the open position and prevents said access in the closed position.

11. The label printer in accordance with claim 10, wherein a holding device is provided to hold the housing element at the housing in the closed position.

12. The label printer in accordance with claim 10, wherein the housing element is provided with a securing means that blocks a movement of the latching holder out of the latching position in the closed position of the housing element.

13. The label printer in accordance with claim 12, wherein the securing means automatically becomes active due to mere closing of the housing element.

14. The label printer in accordance with claim 12, wherein the securing means has a blocking element that is provided at an inner side of the housing element, that projects with a free end in a direction of the latching holder in the closed position of the housing element, and that acts in a blocking manner on the latching holder in the closed position of the housing element.

15. The label printer in accordance with claim 14, wherein the blocking element directly contacts the latching holder in the closed position of the housing element.

16. The label printer in accordance with claim 14, wherein, in the closed position of the housing element, a force acting on the latching holder in a direction of a movement out of the latching position acts on the blocking element such that no torque is exerted onto the foldable housing element.

17. The label printer in accordance with claim 16, wherein the direction of the movement of the latching holder out of the latching position is oriented in parallel with a radial extent of the foldable housing element in the closed position of the housing element and/or is oriented perpendicular to the free end of the blocking element in the closed position of the housing element.

18. The label printer in accordance with claim 10, wherein the housing element foldable about the axis of rotation between the closed position and the open position is a door.

19. The label printer in accordance with claim 1, wherein the axis of the unwinding mandrel runs in a vertical in an operating position of the label printer.

20. A label printer for printing labels wound onto a roll that are applied to a carrier tape or that are linerless endless tape labels, said label printer comprising:

a housing in which a cartridge compartment is formed;

a tape cartridge which at least comprises an unwinding mandrel, in which a label roll can be received, and which can be manually inserted into the cartridge compartment and removed from the cartridge compartment; and a printhead and a driven print roller, wherein a label tape of the label roll can be led between the printhead and the print roller, wherein a spring device and a movable latching holder, which is preloaded into a latching position by a spring force of the spring device, for the tape cartridge are associated with the cartridge compartment, with the tape cartridge being able to be latched into the latching holder against the spring force on the insertion and being able to be unlatched from the latching holder against the spring force on the removal, wherein a housing element foldable about an axis of rotation between a closed position and an open position is attached to the housing and releases access to the cartridge compartment for inserting and removing the tape cartridge in the open position and prevents said access in the closed position, wherein a holding device is provided to hold the housing element at the housing in the closed position, and wherein only a magnetic holder is provided to hold the housing element at the housing in the closed position.

21. A scale comprising a label printer, the label printer comprising:

a housing in which a cartridge compartment is formed;

a tape cartridge which at least comprises an unwinding mandrel, in which a label roll can be received, and which can be manually inserted into the cartridge compartment and removed from the cartridge compartment; and a printhead and a driven print roller, wherein a label tape of the label roll can be led between the printhead and the print roller, wherein a spring device and a movable latching holder, which is preloaded into a latching position by a spring force of the spring device, for the tape cartridge are associated with the cartridge compartment, with the tape cartridge being able to be latched into the latching holder against the spring force on the insertion and being able to be unlatched from the latching holder against the spring force on the removal.

22. The scale in accordance with claim 21, wherein the scale is a store scale.

* * * * *